US008028684B1

(12) United States Patent
Weissmann et al.

(10) Patent No.: US 8,028,684 B1
(45) Date of Patent: Oct. 4, 2011

(54) DEVICE AND METHOD OF THROWING OBJECTS

(76) Inventors: Douglas Weissmann, Cayucos, CA (US); Robert Szemeredi, Soquel, CA (US)

( * ) Notice: Subject to any disclaimer, the term of this patent is extended or adjusted under 35 U.S.C. 154(b) by 553 days.

(21) Appl. No.: 12/151,817

(22) Filed: May 9, 2008

(51) Int. Cl.
*F41B 3/00* (2006.01)

(52) U.S. Cl. ..... 124/5

(58) Field of Classification Search ..... 124/5
See application file for complete search history.

(56) References Cited

U.S. PATENT DOCUMENTS 1,535,029 A 4/1925 Murch
1,865,173 A * 6/1932 Dickerman ..... 124/5
3,428,036 A 2/1969 Parker
3,589,349 A 6/1971 Parker
4,233,952 A * 11/1980 Perkins ..... 124/5
4,347,828 A * 9/1982 Bridgeman ..... 124/5
D424,640 S 5/2000 Oblack
6,076,829 A 6/2000 Oblack

* cited by examiner

*Primary Examiner* — John Ricci
(74) *Attorney, Agent, or Firm* — Stan Collier, Esq.

(57) ABSTRACT

A throwing device has a head for holding an object to be thrown on its distal end. Located near to the head is a catapulting mechanism that is used to further the distance. The catapulting mechanism comprises one or more catapulting devices. A plurality of these catapulting devices may be included thereon, and the flexibility of the spring-like member may be varied as required or desired. During the swing, the weight of the tennis ball and the head cause the spring-like member(s) to rearwardly flex. The user determines when to slow the swing of the head which causes one or more of the catapult devices to decelerate the head with the tennis ball therein wherein a hammer of the catapult device hits a stop and thereby transfers a significant degree of kinetic energy into the motion of the released ball to obtain the greater distance.

5 Claims, 7 Drawing Sheets

DEVICE AND METHOD OF THROWING OBJECTS

BACKGROUND OF THE INVENTION

1. Field of the Invention

The present invention relates to a device and method of throwing objects, and, in particular, relates to a device and method of throwing an object by use of hand and arm action, and, in greater particularity, relates to a device and method of throwing a ball.

2. Description of the Prior Art

Throughout history the need to throw objects by the use of the hand and arm action is well known in the areas of combat, hunting and in play.

In combat and hunting, early man threw rocks and spears by hand since these objects were readily available. In order to reach farther distances with greater forces to kill prey, man developed implements to assist in the throwing of objects with greater accuracy, distance and force. Some of these implements such as the bow and arrow threw specialized objects like arrows. Another device was the sling where a rock was placed in a leather pouch held by two long straps. The thrower would grip the ends of the straps and spin the pouch with the rock in a circular motion until a sufficient speed was reached and then one strap was released to cause the rock to be thrown from the pouch at the target. With sufficient practice, a man could easily kill an animal or man at a great distance. Another implement was the spear that could be held in the hand for hunting, for example, but could also be thrown. Because of its weight, the distance was probably limited to fifty feet or less which put the hunter very close to the wounded game or person that could be very dangerous. In order to reach greater distances, the rear end of the spear was placed in a notch in a throwing stick. With the proper arm motion, the throwing stick effectively lengthened the arm and gave greater force to the spear upon release. Much larger objects could be thrown, but only with the aid of devices such as the catapult developed especially during the middle ages to breach castles. With the development of gunpowder, the need for such implements in combat and hunting ceased to exist as is well known and documented.

In recreational activities on the other hand, the hand throwing of objects like baseballs and footballs continues. The football being specially designed for distance throwing.

In one aspect of recreational activities, the thrower desires to have the object immediately returned to be rethrown which is normally not an issue when another person is participating in the activity such as playing catch. When man plays with "man's best friend," i.e., the dog, the thrown object may be a stick, a special toy such as a flying plate, a ball, and, in particular, a tennis ball. When returning the tennis ball having an absorptive surface of fibers, in particular, the dog's saliva will usually coat the fibers. The thrower of such a tennis ball would obviously prefer to have a clean and dry ball for use because it is more sanitary and easier to grip for throwing. Several issued patents have been directed at this aspect of recreational activities wherein the thrower of the ball uses a device to pickup and throw the ball, and to reduce the effects of repeatedly bending over, to reduce the chance of being nipped by the dog when reaching for the ball, and to be able to throw the ball farther.

One of the earlier patented devices is illustrated in U.S. Pat. No. 1,535,029, issued May 9, 1924, to Murch entitled "Toy." A ball is removably held in a casing where a plurality of curved "tongues" under tension springs hold the ball therein. The ball is picked up by pressing the toy against the ball. The casing is mounted at the end of a long handle. As noted therein, the toy is swung in an arc and when it is abruptly stopped, the forward momentum of the ball causes it to fly from the curved tongues. This toy requires training for optimum distance since it must be stopped in a fairly narrow angle range so that the ball does not greatly press against the upper set of tongues upon exit. It is further seen that the toy requires considerable manufacturing efforts because of the metal parts used therein.

Another patented device is illustrated in U.S. Pat. No. 3,428,036, issued Sep. 1, 1965, to Parker entitled "Ball Gripping and Throwing Apparatus." This apparatus is directed at the methods of throwing baseballs during practice. As seen therein, a ball holding member has four flexible "fingers." The holding member is adjustable in angle in relationship to the handle. Between the holding member and the handle is a flexible member. One embodiment uses a coiled spring and the other embodiment uses a leaf spring as the flexible member. Each embodiment of the flexible member has its advantages and disadvantages. The leaf spring version would only release the ball in a direction perpendicular to the flat side of the leaf spring and, therefore, if the swinging arc is not perpendicular to the leaf spring, a maximum force is not imparted to the baseball upon release. Further, the handle is adjustable in length.

Another embodiment is illustrated in U.S. Pat. No. 3,589,349, issued Jun. 29, 1971, to Parker entitled "Ball-Gripping and Throwing Apparatus," wherein there is no adjustability of the holding member's angle in relation to the handle.

Another patented device is illustrated in U.S. Pat. No. 6,076,829, issued Jun. 20, 2000, to Oblack entitled "Ball Throwing Apparatus and Method." Although the Parker patents are directed at throwing a baseball, no such limitation is noted in Murch, and thus it is clearly possible to play ball with a dog using the Murch device also. The ball is picked up and held by the holding member as it is in the Oblack patent. A swinging action of the arm with the hand holding the handle attached to the ball holding member releases the ball. Whether the ball is thrown to another person or pet is irrelevant in that this purpose is clearly within the common understanding of the use of the both the Murch and the Oblack patents.

As seen in the Oblack patent, a throwing apparatus is of a unitary construction made of plastic. The handle has an upper section having a rearward bend and the half-spherical structure for holding the ball is approximately 30 degrees behind the longitudinal axis of the lower handle section. This angle facilitates the scooping up of the ball from the dog while standing besides the dog. This scooping action is aided by the design of the half spherical structure. There are four opposing plastic "leafs" or "fingers" integral to the structure that are flexible and move to allow the tennis ball to be held therein by the force of the leafs pressing toward the ball.

Accordingly, there is an established need for a throwing device having a source of power for throwing objects farther than the apparatuses as shown.

SUMMARY OF THE INVENTION

The present invention is directed at a throwing device and a method of throwing objects.

The present invention is primarily directed at throwing objects during recreational activities involving other people or animals.

The throwing device has a head means for holding an object to be thrown on its distal end. The head means may further aid in the retrieval of the object to be thrown whether the object is caught in the air or picked up from the ground or placed therein by hand. The thrown object may be a ball such as a baseball, tennis ball, golf ball, play ball, paddle ball, racquet ball, ping pong ball, or similar objects. The primary criteria being that the thrown object may be held in the hand. The head of the throwing device may be thus designed to catch any of these objects. Located near to the head is a catapulting means that is used to further the distance that may be reached by directing the kinetic energy almost totally to the thrown object. The catapulting means comprises one or more catapulting devices being integral to the throwing device. The catapulting device allows the rearward flexing of the head more than would otherwise be possible by means of a spring-like member as the arm drives the device in an arc. As the head slows in order to release or throw the object, the spring-like member returns and over shots its original position and impacts upon a stop thus catapulting the object from the head. A plurality of these catapulting devices may be included thereon, and the flexibility of the spring-like member may be varied as required for different objects. A shaft extends from the catapulting means to a proximal end having a handle thereon.

In the present invention, the preferred embodiment is directed at throwing a tennis ball and retrieving the same whether it is thrown by another person or returned by a dog.

In operation, the user retrieves the tennis ball from the dog, assuming that the dog has dropped the tennis ball from its mouth. The head has a partial spherical member mounted on an arm connected to the upper shaft. A locking member is connected also to the upper shaft that is used to temporarily hold the ball to the partial spherical member after the ball is retrieved. Once therein, the user who is holding the throwing device by hand on the handle starts to accelerate the head in an arc. The weight of the tennis ball and the head cause the spring-like member(s) to rearwardly flex. The user determines when to slow the swing of the head which causes one or more of the catapult devices to decelerate the head with the tennis ball therein wherein a catapult's hammer strikes the stop and thereby transfers a significant degree of kinetic energy into the motion of the released ball.

An object of the present invention is to provide a means for throwing objects a greater distance than would be obtained by a throwing device without the present invention therein.

It is another object of the present invention to provide a throwing device for use in recreational activities.

It is a further object of the present invention to provide a throwing device having a head that cooperates with a locking member to hold a ball therein.

It is a still further object of the present invention to provide a throwing device that uses a catapulting means therein to achieve the greater distances.

It is yet another object of the present invention to provide a throwing device being economical to manufacture.

It is yet a further object of the present invention to provide a throwing device that is capable of retrieving the object to be thrown without the use of hands on the object.

It is still yet an object of the present invention to provide a throwing device that is capable of retrieving the object to be thrown, temporarily holding the object to be thrown, and releasing the object when desired by the user.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

The present invention is directed at a throwing device and a method of using the throwing device.

Figure 1:
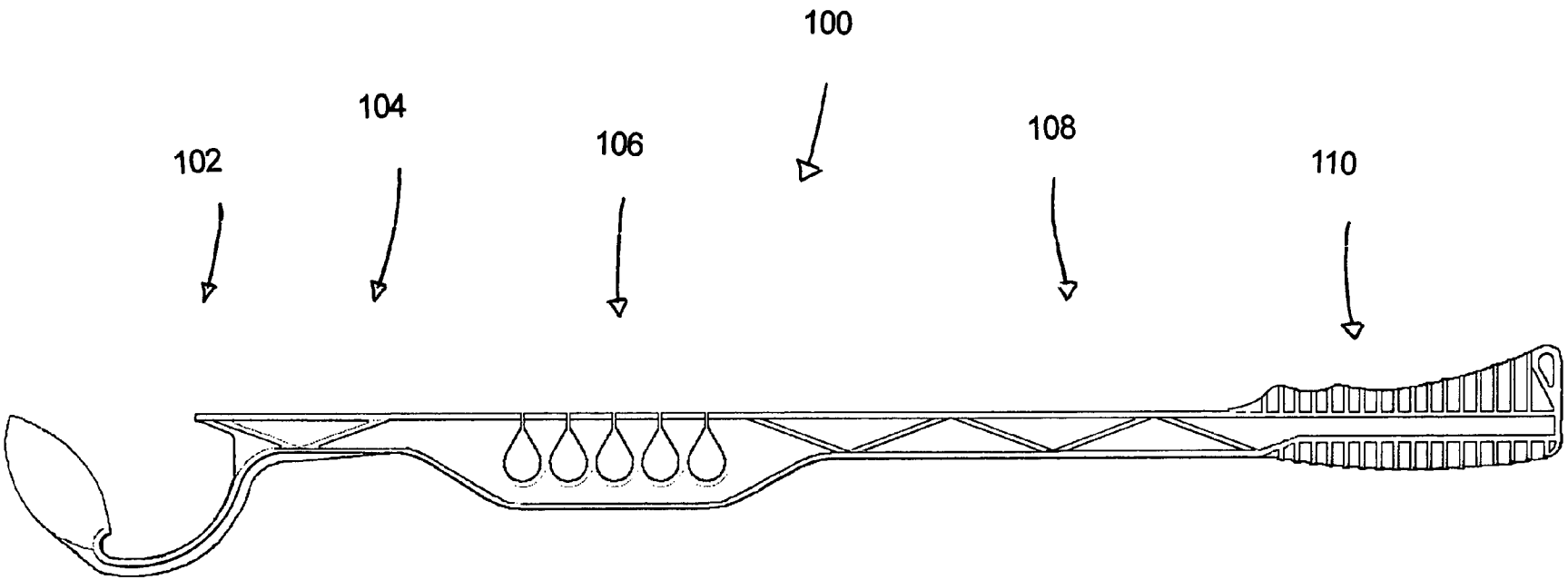
FIG. 1 is a side view of a preferred embodiment of a throwing device of the present invention.

Turning to the drawings, wherein like components are designated by like reference numerals throughout the various figures, attention is initially directed to FIG. 1 which illustrates by a side view a throwing device 100 according to the present invention.

As best shown in FIG. 1, a throwing device 100 is composed of a head means 102, an upper or distal shaft 104, a catapulting means 106, a lower or proximal shaft 108, and a handle 110, to be described hereinafter.

Figure 7:
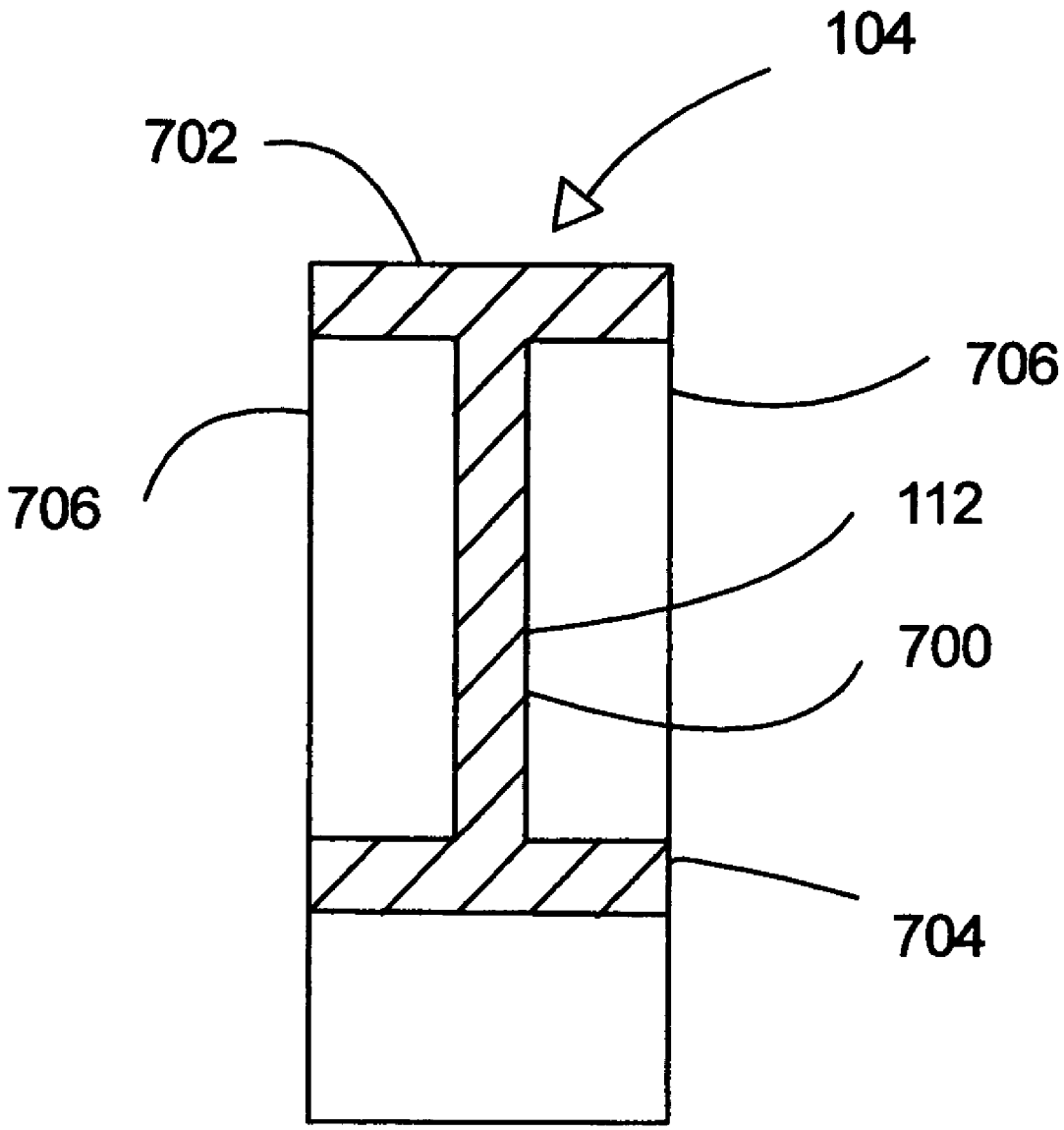
FIG. 7 illustrates by a cross section a shaft of the present invention.

In the preferred embodiment, the throwing device 100 is composed of a conventional plastic material formed in a conventional molding process. The plastic may be colored and a side 112, FIG. 2A, may be essentially flat in shape to allow the attachment of a trademark, letters, numbers or other shapes thereon. FIG. 7 illustrates a cross section of shaft 108/104. The shaft 104 has a center wall 700, a top rail 702, a bottom rail 704, and intermediate supports 706 thereto. These are unitarily constructed of a plastic material.

The present invention is primarily directed at throwing objects during recreational activities involving other people or animals. In particular, the throwing device 100 may be used to retrieve a tennis ball 200, FIGS. 2A and 2B, and hold the ball 200, shown in outline, until it is thrown by the user, not show. The preferred embodiment of the present invention is directed at the tennis ball 200, although other objects, in particular, balls may be used by making modifications to the present invention as will be explained below.

The throwing device 100 has the head means 102 for holding an object to be thrown. The head means 102 is on a distal end 116 being opposite from the handle 110. The head means 102 may further aid in the retrieval of the object to be thrown whether the object is caught in the air or picked up from the ground or placed therein by hand.

Figure 2A:
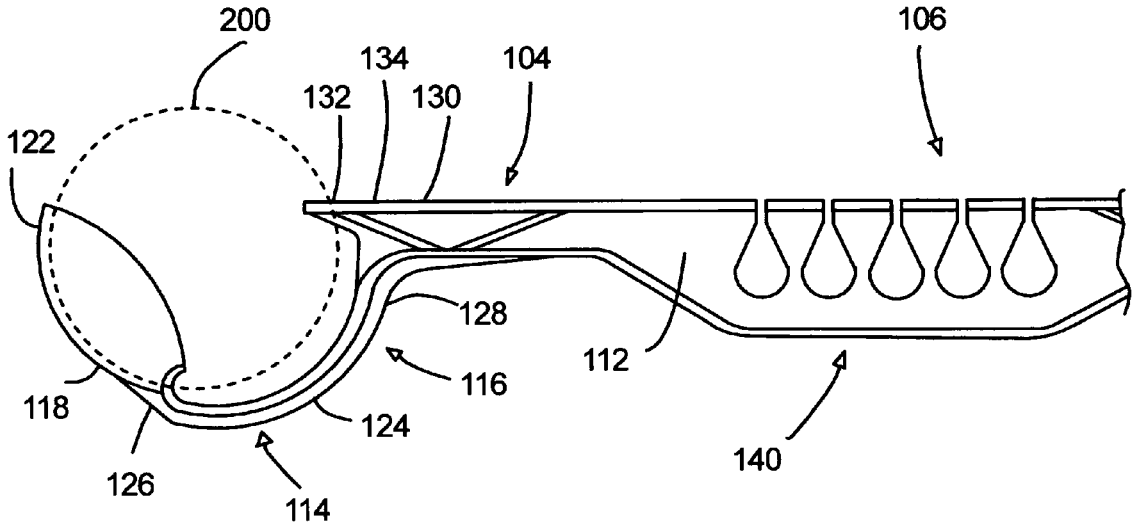
FIG. 2A is an enlarged view of a head, a distal shaft and a catapult means of FIG. 1.
Figure 2B:
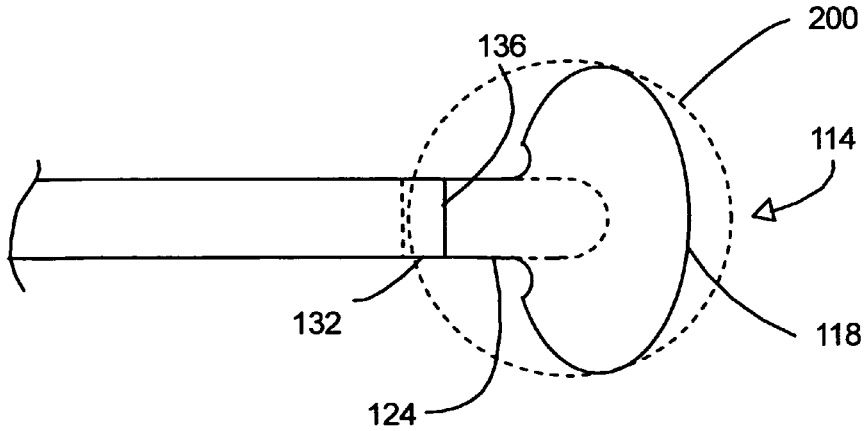
FIG. 2B is a top view of the head of FIG. 2A.

As seen in FIG. 2A, the head means 102 has a holding member 114 having a partial spherical member 118 with a shell-like wall 122 of plastic. The holding member 114 by itself does not hold the ball therein when turned to the side or inverted. The holding member 114 is attached to an arm 124. The distal end 126 of the arm 124 connects to the backside of the member 118 and the proximal end 128 attaches to a distal end 130 of an upper shaft 104. The arm 124 between the ends 126 and 128 is curved and is flexible to a predetermined degree as will be made clear herein.

In order to hold the ball 200 on the throwing device 100, a locking member 132 is attached to the distal top end 134 of the shaft 104 and extends sufficiently in the forward direction to prevent the ball 200 from being easily inserted therein. As the ball is pushed into the holding position shown in FIG. 2B, the arm 114 flexes downward so that the locking member 132 holds the ball 200 therein. The locking member 132 may be rectangularly shaped. A tip 136 of the locking member 132 is positioned over/above the large diameter of the ball 200 to securely hold the ball 200 therein until the ball 200 and the head means 102 is flexed sufficiently downward to allow the ball 200 to be thrown therefrom.

Figure 2C:
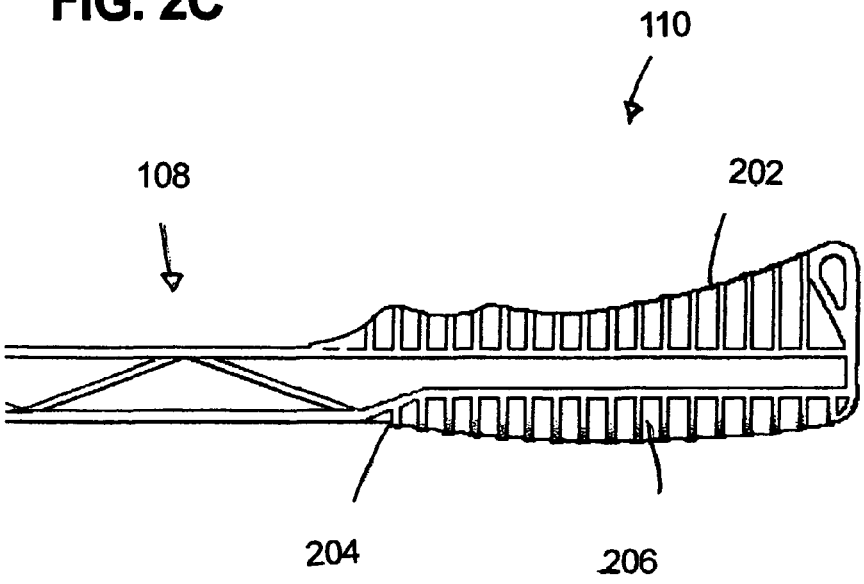
FIG. 2C is an enlarged view of a handle and proximal or lower shaft of FIG. 1.

FIG. 2C illustrates by side view the handle 110 connected onto the lower shaft 108. The handle 110 is shaped to fit within a gripped hand. The fingers would go over a top 202 with the thumb along a bottom 204. The handle 110 has a plurality of grooved ridges 206 to aid in gripping the throwing device 100.

The head means 102 is connected to the upper shaft 104 and located oppositely thereto is a catapulting means 106 that is used to farther the distance that may be reached by directing the kinetic energy almost totally to the thrown object as provided for in one or more catapult devices 140.

Figure 3:
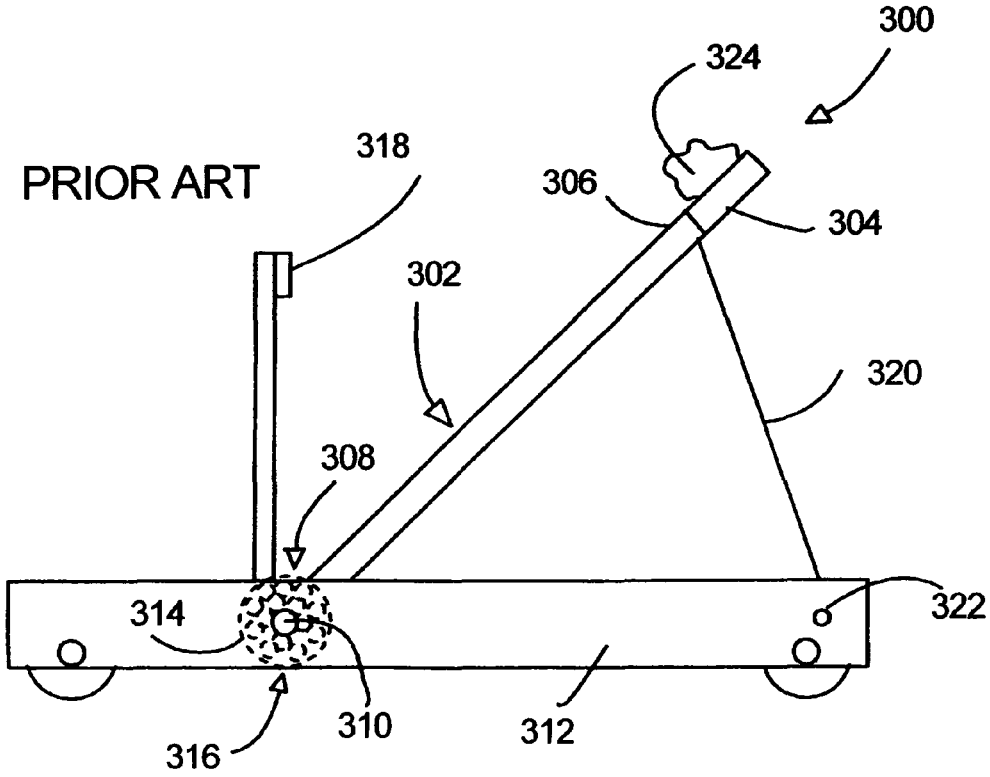
PRIOR ART FIG. 3
FIG. 3 illustrates by a side view a simple Roman Mangonel torsional catapult as will be used to explain the operation of the present invention.

Referring to FIG. 3, a conventional Roman Mangonel torsion catapult 300 is shown. As seen there, a throwing arm 302 has a holding means 304 at its distal end 306 holding such conventional material as a rock 324, boulders, etc. At its proximal end 308, a shaft 310 is pivotally mounted perpendicular to a frame 312. Further, a torsional device 316 is positioned at the end 308 of the arm 302 and the end 308 is wrapped in a bundle of rope 314 that is secured to the frame 312 on both sides of the arm 302. A large wooden turning shaft, not shown, is placed through the bundle 314 and is used to turn the bundle of rope 314 in a counter clockwise direction forcing the arm 302 against the stop 318. A draw rope 320 is attached to the distal end 306 and about a shaft 322 rotatably secured in the frame 312. The shaft 322 is turned and this causes the throwing arm 302 to be drawn backwards a sufficient amount. This further places additional torsional forces on the throwing arm 302. At the release of the shaft 322 or draw rope 320, the rotational forces rotate the arm 302 very quickly into the stop 318 that is further secured to the frame 312. At that point or slightly before that depending on the forces, the rock 324 is thrown forward at great velocity to go a long distance.

Figure 4A:
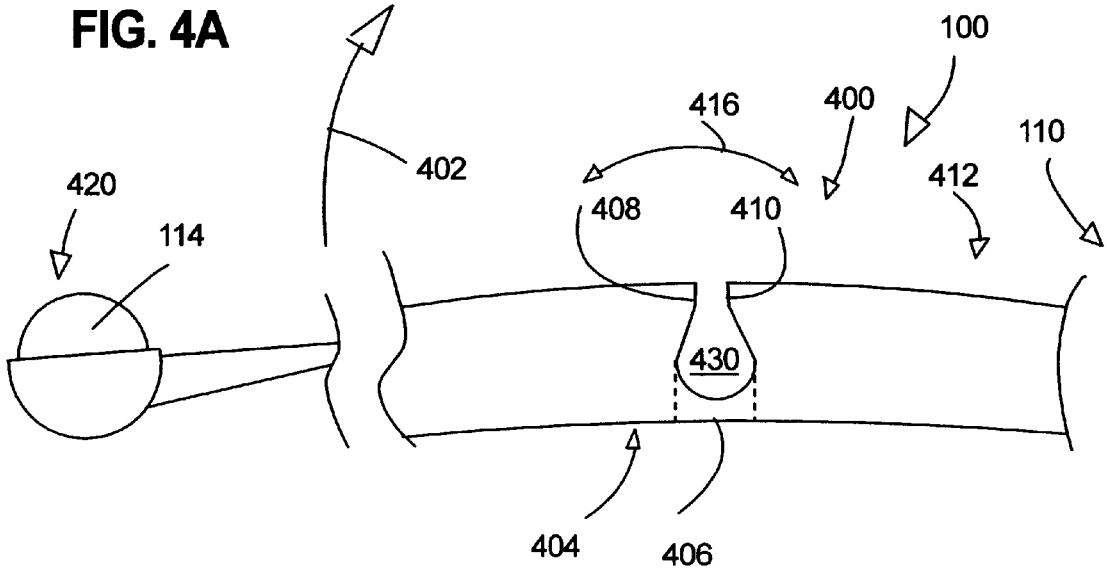
FIG. 4A and FIG. 4B illustrate one catapult means of the present invention in a "primed" condition and a "released" condition, respectively.
Figure 4B:
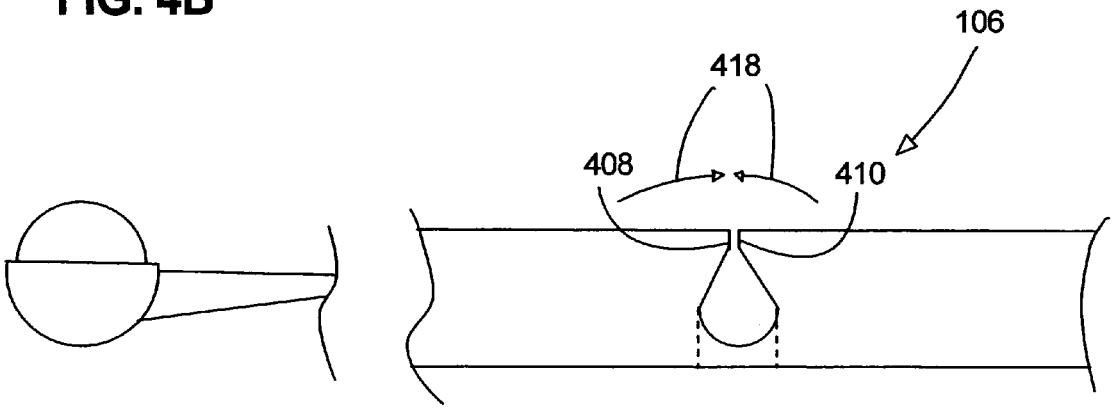

As shown in FIGS. 4A and 4B, the catapulting means 106 of the present invention is further detailed. In FIG. 4A, the user, not shown, grabs by hand the handle 110 such as shown in FIG. 2C. The tennis ball 114 is positioned in the head means 402. As the user's arm swings the throwing device 100 in an arc 402, the inertia of the tennis ball 114 and the head means 402 causes the throwing arm 404 to flex backward opening up the neck space between the throwing arm 404's hammer 408 and stop 410. See arrow 416. The torsional energy is generated by the arm movement and flexing of a torsional member 406 being the spring-like member mentioned above and is approximately limited in area by the dashed lines shown, and the torsional member 406 is located between the upper throwing arm 404 and the lower throwing arm 412. Through practice, the user will start to slow the motion of the arm that in turn decelerates the head means 402. As this occurs, the hammer 408 comes forward and hits the stop 410, see arrows 418 in FIG. 4B, and essentially simultaneously throws the ball 114 forward with greater force than would occur without the catapult means 400.

Figure 5:
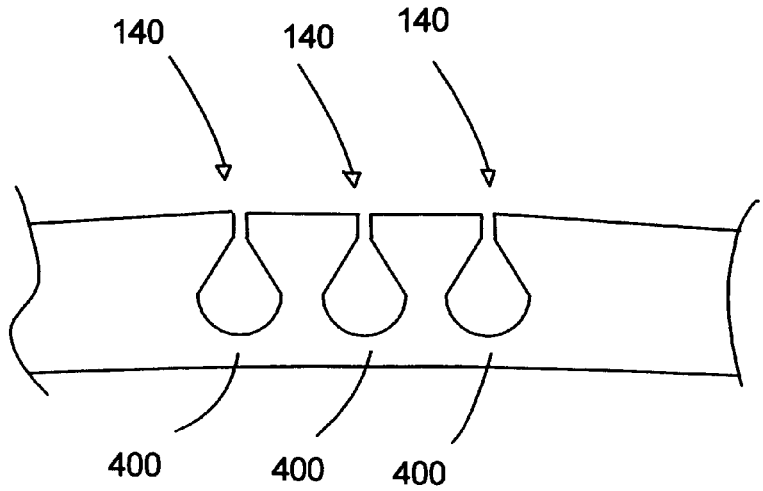
FIG. 5 illustrates the catapult means of the present invention having three catapult devices in a "primed" condition.
Figure 6:
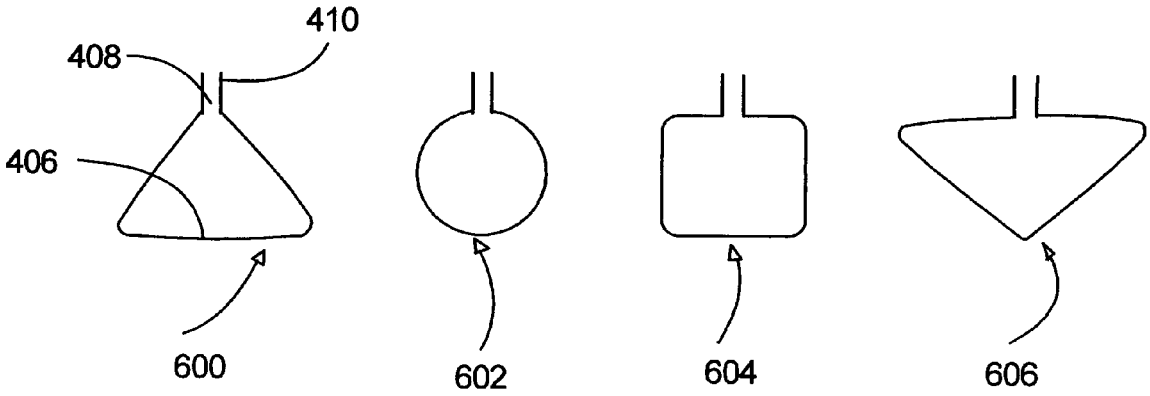
FIG. 6 illustrates various shapes which may be used in the catapult devices of the present invention.

As seen in FIG. 1 of the preferred embodiment, the throwing device 100 has five catapult devices 140 in the catapult means 106. In FIG. 5, three catapult devices 140 are shown in the "primed" condition. FIG. 6 illustrates four different shapes of the space 430, FIG. 4A, between the hammer 408 and the stop 410 and torsional member 406. Space 600 is essentially triangular shaped with the apex open; the preferred embodiment of FIG. 1 is tear-dropped shaped; space 602 is essentially circular; space 604 is essentially rectangular; and space 606 is triangular with the opening opposite the apex. The torsional energy is determined by the flexible member 406's composition, length, thickness, and width that is different for each of the shapes shown in FIG. 6.

The catapulting means 106 comprises one or more catapulting devices 140 being integral to the throwing device. The catapulting device 140 allows the rearward flexing of the head greater than would otherwise be possible without the means of a spring-like member as the arm drives the device in an arc. As the head slows in order to release or throw the object, the spring-like member returns and over shots its original position and impacts upon a stop thus catapulting the object from the head. A plurality of these catapulting devices may be included thereon, and the flexibility of the spring-like member may be varied as required or desired by the potential user during manufacture.

Figure 8A:
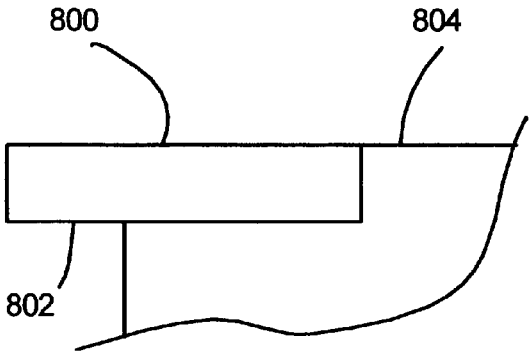
FIGS. 8A to 8D illustrate an embodiment of the present invention in various views a construction and use of an adjustable locking member for use with balls of different sizes.
Figure 8B:
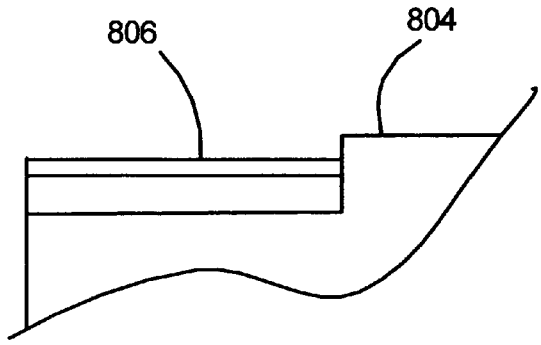
Figure 8C:
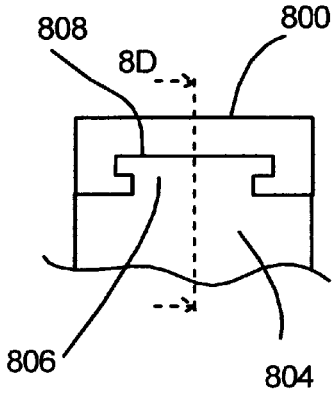
Figure 8D:
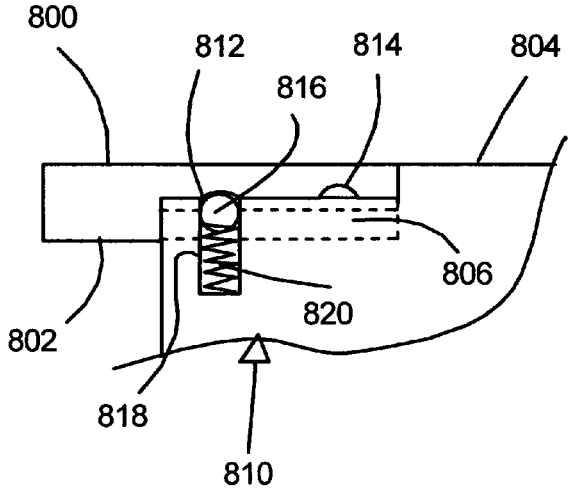

FIG. 8A illustrates by a side view a locking member 800 mounted to the upper shaft 804. In the preferred embodiment, the locking member 800 has a sufficient length extension 802 to engage a tennis ball. Other balls may be used with the present invention, but the extension 802 must be adjusted if the balls are smaller than a tennis ball. For example, a racquet ball, not shown, is a rubber ball of smaller diameter than a tennis ball. One possible device is a cap that fits over the end of the extension 102. Different sizes of caps can be used for different sizes of balls, and further, the caps may have other features thereon to hold down smaller balls as necessary. In the preferred embodiment, the locking member has an appearance such as a "reed." FIG. 8C is a front view of FIG. 8A. As seen therein, the upper shaft 804 has a rail 806 upon which the locking member 800 having a rail shaped channel 808 slides thereon. FIG. 8B is a side view of the rail 806 without the locking member 800 thereon. FIG. 8D is a cross sectional side view through the locking member 800, the rail 806 and upper shaft 804 as shown in FIG. 8C. A detent device 810 is used to hold and prevent the locking member 800 from falling off of the throwing device 100. A soft detent hole 812, being a small spherical hole, holds the locking member 800 in a tennis ball position. This being an optional feature. A hard detent 814, being a larger spherical hole, holds the locking member 800 in a racquet ball position, for example, by extending the extension 802 an additional ½ inch. A detent ball 816 is mounted in a hole 818 in the rail 806. A coil spring 820 pushes/biases the ball upward. The locking member 800 is pushed forward, to the left in FIG. 8D, until the detent ball 816 engages in the hard detent hole 814. In this position, a racquet ball may be thrown by the throwing device 100.

In the present invention, the preferred embodiment is directed at throwing a tennis ball and retrieving the same whether it is thrown by another person or returned by a dog.

In operation, the user retrieves the tennis ball from the dog, assuming that the dog has dropped the tennis ball from its mouth. The throwing device has a sufficiently long handle thereon and a head with a partial spherical member for obtaining the tennis ball on the ground without bending over greatly. The partial spherical member is not able to grip or hold the tennis ball so that it remains in the partial spherical member until thrown. A locking member located on the upper shaft of the handle extends sufficiently near to the partial spherical member so as the tennis ball is pushed therein, the spherical member flexes therefrom and allows the ball to become "wedged" therebetween. Once therein, the user who is holding the throwing device by hand on the handle starts to accelerate the head in an arc. The weight of the tennis ball and the head cause the spring-like member(s) of the catapult means to rearwardly flex. Because of this acceleration, the tennis ball becomes unwedged, but remains positioned on the holding member until the user determines when to slow the swing of the head with the tennis ball therein. The catapult arm(s) strike the stop and thereby transfers a significant degree of kinetic energy into the motion of the released ball as it is thrown from the throwing device.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A throwing device for throwing an object, for use by a person who holds said throwing device in a hand, comprising:

head means for holding the object, the object being removably held by a partial spherical member upon an arm, said arm connected to a distal end of a shaft of said throwing device;

a locking member being connected to said distal end of said shaft of said throwing device, wherein said locking member is a flexible rectangular-like member having sufficient width to hold the object once the object is seated in the partial spherical member, and releases the object from the partial spherical member upon a sufficient force;

catapult means for increasing a distance the object is thrown, said catapult means being located within said shaft;

a handle, said handle connected to a proximal end of said shaft, wherein said locking member biases the object to be thrown into said partial spherical member, wherein said partial spherical member upon said arm is biased by said locking member to sufficiently hold the object therein until a sufficient force is applied thereto by said catapult means.

2. A throwing device for throwing an object, wherein the object is a ball for use by a person who holds said throwing device in a hand, comprising:

head means for holding the object, the object being removably held by a partial spherical member upon an arm, said arm connected to a distal end of a shaft of said throwing device;

a locking member being connected to said distal end of said shaft of said throwing device;

catapult means for increasing a distance the object is thrown, said catapult means being located within said shaft;

a handle, said handle connected to a proximal end of said shaft, wherein said locking member biases the object to be thrown into said partial spherical member, wherein said partial spherical member upon said arm is biased by said locking member to sufficiently hold the object therein until a sufficient force is applied thereto by said catapult means.

3. A throwing device for throwing an object, for use by a person who holds said throwing device in a hand, comprising:

head means for holding the object, the object being removably held by a partial spherical member upon an arm, said arm connected to a distal end of a shaft of said throwing device;

a locking member being connected to said distal end of said shaft of said throwing device;

catapult means for increasing a distance the object is thrown, said catapult means being located within said shaft, said catapult means is a torsional catapult means, wherein said catapult means includes one or more catapult devices, wherein said catapult device is connected within said shaft forming a throwing arm, wherein said catapult device comprises said throwing arm, a flexing member, said flexing member connected to said throwing arm with a stop;

a handle, said handle connected to a proximal end of said shaft, wherein said locking member biases the object to be thrown into said partial spherical member, wherein said partial spherical member upon said arm is biased by said locking member to sufficiently hold the object therein until a sufficient force is applied thereto by said catapult means.

4. The throwing device as recited in claim 3, wherein said catapult device includes a space between said throwing arm, said flexing member and said stop, said space substantially narrowing to a neck space between a hammer of said catapult device and said stop.

5. The throwing device as recited in claim 4, further including a space within said catapult device, said neck space being between said stop and said hammer.

* * * * *